United States Patent [19]

Gerding et al.

[11] 4,217,177

[45] Aug. 12, 1980

[54] VENTED COKE OVEN DOOR APPARATUS

[75] Inventors: Charles C. Gerding; Harry B. Brown, Jr., both of Pittsburgh, Pa.

[73] Assignee: Jones & Laughlin Steel Corporation, Pittsburgh, Pa.

[21] Appl. No.: 966,848

[22] Filed: Dec. 5, 1978

[51] Int. Cl.[2] ..... C10B 25/06

[52] U.S. Cl. ..... 202/248

[58] Field of Search ..... 202/248, 242; 110/173 R, 180

[56] References Cited

U.S. PATENT DOCUMENTS

| | | | |
|---|---|---|---|
| 1,745,390 | 2/1930 | Wilputte | 202/248 |
| 2,993,845 | 7/1961 | Coe | 202/248 |
| 3,505,174 | 4/1970 | Peterson et al. | 202/248 |
| 4,118,284 | 10/1978 | Bowman et al. | 202/248 |

FOREIGN PATENT DOCUMENTS

| | | | |
|---|---|---|---|
| 417460 | 9/1974 | U.S.S.R. | 202/248 |

*Primary Examiner*—Arnold Turk

*Attorney, Agent, or Firm*—Thomas H. Murray; Clifford A. Poff

[57] ABSTRACT

A vented coke oven door includes a door frame having a vertical face surface carrying a plug assembly having a central vertical internal opening to conduct coke oven gas generated at the bottom of a coal charge in a coke oven chamber. The plug assembly includes a plurality of U-shaped refractory plug segments arranged in an end-to-end aligned relation with leg sections of each U-shaped segment extending horizontally into an abutting relation with the face surface of the door frame. Each leg section carries either an embedded hooked end or a T-shaped head of a threaded fastener which is supported by the door frame so that the leg sections are unrestrained against movement toward and away from each other in response to a thermal gradient across the wall thickness of the refractory plug segment. A backing plug plate is fitted into a recess in the leg sections of each plug segment to provide a closure wall to the U-shaped configuration of the segments and forms the vertical passageway for conducting coke oven gas. The backing plug plate has an exposed layer of cast refractory overlying a layer of insulation used to protect the door frame. A seal strip extends about the outer periphery of the door frame to prevent emission of coke oven gas from the coking chamber.

9 Claims, 4 Drawing Figures

VENTED COKE OVEN DOOR APPARATUS

BACKGROUND OF THE INVENTION

This invention relates to a plug-type coke oven door for venting coke oven gases through a central vertical hole open at the top and bottom of the plug to relieve the pressure of gases generated at the bottom of a coal charge in a coke oven chamber. More particularly, the present invention relates to such a plug-type coke oven door embodying a particular construction and arrangement of parts to avoid the development of destructive thermal stresses in the plug due to rapid heating and cooling.

Environmental emissions are a problem by today's standards that must be overcome when operating a battery of horizontal recovery-type coke oven chambers. One principal form of pollution occurs from coke oven chambers when smoke and hydrocarbons escape from coke oven doors at both ends of an oven chamber. The integrity of seals for coke oven doors is difficult to maintain throughout long periods of operation. The doors must be removed at the conclusion of the coking process for pushing operations. During the early part of the coking cycle, large volumes of coke oven gas evolve. While a collector main is used to withdraw the gas, these collector mains communicate only with the free space above a coal charge and the gas must somehow reach this free space for withdrawal by the collector main. The flow paths for the gas through a coal charge from the bottom of a coke oven chamber are generally upward along courses of least resistance.

Coke oven gas generated at the middle of a coal charge in the coke oven chamber will flow generally upwardly through the coal charge to the free space thereabove and then through the ascension pipe into the collector main. On the other hand, a quantity of gas generated near the end of the coke oven chamber is more likely to travel horizontally to a "gas channel" at the site of the coke oven door and then upwardly to the free space above the coal charge. The "gas channel" is a clearance or space between the coke oven door and the jamb. The gas channel runs along the entire circumference of the door so that, in theory, the gas channel provides a flow path for gas to travel from the bottom of the coke oven chamber to the free space above the coal charge. In this way, the pressure of the coke oven gas is relieved at the bottom of the coke oven door. In practice, however, the gas channel is anything but a clear space and is often blocked with coal, coke and/or tar. Peak gas pressures at the bottom of the coke oven door are generally reported at about 200 millimeters of water, although some reports describe peak gas pressures at over 700 millimeters of water. The gas pressure drops from its maximum to a few millimeters of water after several hours and settles down to an even lower pressure, usually around 2 millimeters of water, throughout the remaining part of the coking cycle. The pressure of coke oven gas in the gas channel must be contained by the usual door seal strip to avoid emissions from the coke oven door. By minimizing the pressure of coke oven gas in the gas channel, and thus the gas pressure against the door seal, emissions from the coke oven doors are correspondingly minimized.

The pressure of coke oven gas in the gas channel is dependent, inter alia, upon the gas pressure at the free space above a coal charge and any pressure drop occurring along the gas channel. Gas pressures in the free space above a coal charge are slightly greater than the collector main gas pressure. However, significantly higher gas pressures develop when restrictions in the free space occur due to carbon buildup or improper leveling of a coal charge as well as inadequate cleaning in the gas-conducting conduits of the ascension pipe network. For example, it has been observed that cleaning an overly dirty passage from the free space above the coal to the collector main caused the pressure in the gas channel to drop immediately from 46 millimeters of water to 6 millimeters of water and that heavy emissions from the door seal were immediately eliminated. While the occurrence of unusual operational conditions, such as the above, in a coke oven battery brings about undesirable emissions, the reliance on the gas channel to provide a flow space for coke gas from the bottom of the coke oven chamber to the top portion thereof is undesirable even under normal operating conditions because it imposes excessive demands upon the integrity of the door seal strip.

Techniques developed in the past to reduce the gas channel pressure include the formation of a coal seal by reducing the clearance between a refractory door plug and the wall of the coke oven chamber to prevent coal from entering the gas channel area. However, difficulties are frequently encountered when attempting to set the door in place when the gap between the plug and the oven wall is sufficiently reduced. A further technique to minimize restrictions to the flow of coke oven gas in the gas channel employs the concept of undercutting the plug on the coke oven door to enlarge the gas channel. However, due to the flow of hot gases in the enlarged gas channel, overheating of the coke oven door will occur. A still further technique is to provide an alternate flow path for the coke gas within an internal vertical hole along the entire length of the door plug to relieve pressures of coke oven gas at the bottom of the door. Side vents along the height of the plug leading into such a hole have also been used to relieve the pressure of coke oven gas at intermediate points along the height of the door. The concept of a vented plug is particularly desirable since the flow of pressurized coke gas is diverted from the gas channel area, thus relaxing demands on the integrity of the door seal strip. However, known vented plug designs suffer from acute disadvantages which the present invention is designed to overcome. A relatively small gas-conducting opening in some vented plug designs becomes plugged due to the buildup of tar and other material from the gases. This accumulation of foreign material can be removed through systematic cleaning operations, but this is not seen as an acceptable solution to the problem. An alternative suggestion in the past has been to provide a very large central opening in the plug surrounded by relatively thin plug walls so that the plug operates at a relatively high temperature and thereby burn deposits on the wall forming the gas-conducting channel in the plug. Because the wall thickness of the plug is small, large hoop stresses develop whereby thermal cracking is a serious problem that reduces the life of the door plug.

SUMMARY OF THE INVENTION

It is an object of the present invention to provide a coke oven door embodying a vented plug principle with an improved construction and relationship of parts to avoid the development of undesirable thermal stresses in the plug element while at the same time enabling the use of a vented opening which is sufficiently large in cross section to burn away any deposits from coke oven gas passing through the opening in the vented plug.

It is a further object of the present invention to provide a coke oven door apparatus including a vented plug assembly consisting of unique discrete elements joined together to form a vertical internal opening for the conduction of coke oven gas from the bottom and possibly intermediate points of the coke oven chamber wherein the wall thickness of the plug is small and the vented opening is large for continuous operation without a buildup of deposits including carbon but insulated for a minimum of heat transfer to the door frame.

It is another object of the present invention to provide a vented coke oven door apparatus with a plug assembly principally comprising refractory parts supported through an improved mounting to allow thermal expansion.

More particularly, according to the present invention, there is provided a vented coke oven door apparatus for a coke oven chamber to relieve coke oven gas pressures generated at the bottom of a coal charge in the coke oven chamber, the vented coke oven door assembly includes the combination of a door frame having a vertically-extended height substantially corresponding to the height of the coke oven chamber, a plug assembly defining a vertical internal passageway while supported by the door frame along one vertical surface thereof to project into the coke oven chamber for conducting coke oven gas from the bottom portion of the coke oven chamber to the top portion thereof, the plug assembly including a plurality of U-shaped refractory plug segments arranged in an end-to-end relation with leg sections of each U-shaped segment extending to the vertical face surface of the door frame, the plug assembly further including a back-plug means spanning the distance between the leg sections of the plug segments while extending along the door frame to thermally protect the door frame from contact with coke oven gas flowing along the vertical internal passageway of the plug assembly, one or more fasteners extending between the door frame and each leg section of the U-shaped refractory plug segments for support thereof while undergoing thermal expansion including movement of the leg sections toward and away from each other in response to a thermal gradient across the wall thickness of each refractory plug segment, seal means extending about the periphery of the door frame to prevent the emission of coke oven gas from the coke oven chamber, and latch means carried by the door frame for support thereof.

In the preferred form of the present invention, the aforesaid back-plug means includes a layer of insulation facing the door frame and an overlying layer of cast refractory material facing the hollowed-out surface of the refractory plug segments so as to define a side wall closure to the internal space of the segments for conducting coke oven gas therealong. It has been found that the horizontal, transverse cross-sectional area of the vent opening should be at least 32 square inches, but preferably on the order of 50 to 60 square inches to thereby continuously maintain an unplugged flow space for coke oven gas. Moreover, the refractory plug segments preferably have a wall thickness between about 2 inches and 3 inches for a high temperature heat transfer to burn away any deposits from the wall surfaces surrounding the vertical gas flow space. The leg sections of the refractory plug segments include recesses for receiving the side edge of the back-plug means. The back-plug means preferably takes the form of a plate comprised of a layer of insulation and an overlying layer of cast refractory material.

According to one embodiment of the present invention, the aforesaid fastener includes a threaded bolt member having a T-shaped head. When this form of fastener is used, it is preferred that each leg section of the refractory plug segments includes a T-shaped slotted opening within the side wall thereof for supporting the T-shaped head of the threaded bolt member so that the threaded portion thereof is passed through an opening in the door frame and retained through the agency of a nut member. In a second embodiment of the present invention, the aforesaid fastener includes a threaded bolt member having a hook-shaped end that is embedded within a leg section of a refractory plug segment so that the threaded portion of the bolt member extends through an opening in the door frame for support through the agency of a nut member.

These features and advantages of the present invention as well as others will be more fully understood when the following description is read in light of the accompanying drawings, in which.

Figure 1:
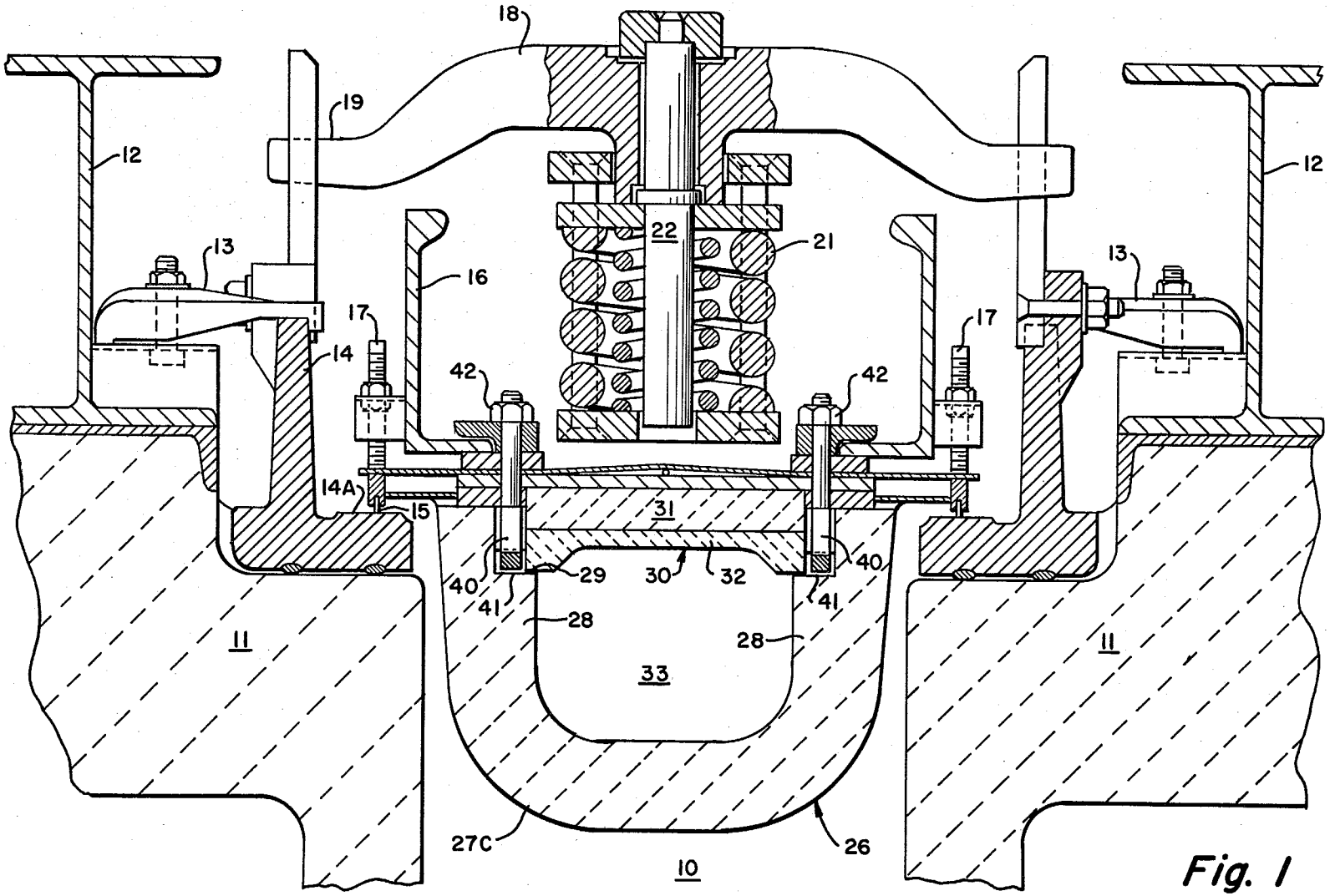
FIG. 1 is an elevational view, in cross section, of a coke oven chamber illustrating the vented coke oven door apparatus of the present invention.

In FIG. 1, reference numeral 10 denotes a horizontal coke oven chamber in a recovery-type coke oven battery. Refractory bricks form vertical heating walls 11 that are supported by the usual buckstays 12. Clamp members 13 attached to the buckstays retain a doorjamb 14 within a recess that is formed by the refractory bricks at the end of the heating walls 11. The doorjamb as well known in the art has a rectangular form to extend around the opening of the coke oven chamber. The doorjamb includes a flat seal surface 14A for engagement by an edge seal 15 spaced outwardly from a door frame 16 forming part of a coke oven door embodying the features of the present invention. Adjusting screws 17 spaced about the periphery of the door frame 16 position the edge seal against the surface 14A of the doorjamb. A locking bar 18 is provided at each of the top and bottom portions of the door frame where hook-shaped bars 19 project outwardly from the door frame to absorb the reaction force developed by the compression of springs 21 arranged between the locking bar and the door frame. A flanged spindle 22 is used to compress the springs 21 against the door frame and thereby hold the door frame in place at the end of a coke oven chamber while developing a considerable pressure used in part to force the edge seal 15 against the sealing edge 14A.

Figure 2:
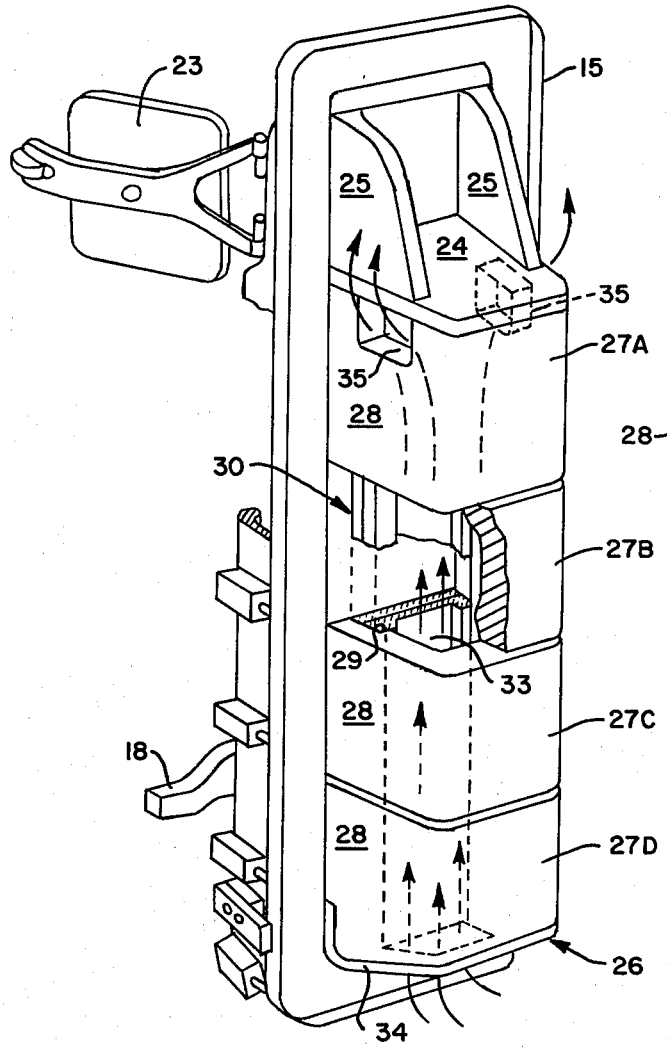
FIG. 2 is a perspective elevational view of the coke oven door apparatus embodying the features of the present invention shown in FIG. 1.

A chuck door 23 is shown in FIG. 2 hingedly mounted to the top portion of the coke oven door, in this case, a pusher side door, for the insertion of a leveling bar into the coke oven chamber through an opening that is bounded by a floor plate 24 and side plates 25. The plates 24 and 25 project from the door frame into the coke oven chamber to facilitate movement of the leveling bar required for the leveling operations. It is to be understood, of course, that the coke oven door for the coke side of the oven chamber does not include the chuck door 23, floor plate 24 and side plates 25. A vented door plug assembly 26 is carried on the vertical face surface of the coke oven door. The vented plug assembly includes a plurality of U-shaped refractory plug segments, four of which are employed according to the embodiment shown in FIGS. 1 and 2 and identified by reference numerals 27A–27D. The U-shaped refractory plug segments are arranged in a superimposed end-to-end relation to extend along the vertical face surface of the coke oven door which is directed toward the coke oven chamber. Each U-shaped refractory plug segment includes leg sections 28 that extend in a spaced-apart relationship as defined by the U-shaped cross section toward the coke oven door where the end face surfaces of the leg sections 28 abut against the door frame 16. The face surface of each leg section which is directed toward the space surrounded by the refractory plug segment includes a recess 29. A backing plug section 30 takes the form of a composite plate arranged on the vertical face surface of the coke oven door to span the distance between leg sections 28 and extend in an interfitting relation into the recesses 29 thereof. The backing plug section 30 as best shown in FIG. 1 is comprised of a layer of insulation 31 in contact with the coke oven door and carries in overlying layer of castable refractory material 32. When in its operative position, the vented plug assembly forms a vertically-extending opening 33 to conduct coke oven gas from the bottom of a coke oven chamber. The coke oven gases enter the opening 33 which as shown in FIG. 2 opens out of lowermost refractory plug segment 27D. The refractory material of this plug segment is protected along its lowermost surface by a plate member 34. The U-shaped refractory plug segments 27A–27D are preferably arranged so that a gap exists between the abutting face surfaces of the segments, to thereby permit egress of coke oven gas from the coke oven chamber through these gaps into the channel 33. As noted above, the coke oven door assembly shown in FIGS. 1 and 2 includes the necessary chuck door and the plates 24 and 25 whereby the entire top surface of the uppermost plug segment 27A is closed by the plate 24. The uppermost plug segment 27A includes an opening 35 in each leg section 28. The total area of these openings is sufficiently large so that coke oven gases flowing in channel 33 readily escapes from the channel to the space above the coal charge via the openings 35. It is to be understood, of course, that openings 35 are not provided in the U-shaped refractory plug segment which is located at the uppermost location on a coke oven door at the coke side of an oven chamber. At the coke side, the gases flow along channel 33 in only a vertical direction whereby they are discharged from the uppermost segment of the refractory plug into the space above the coal charge.

Figure 3:
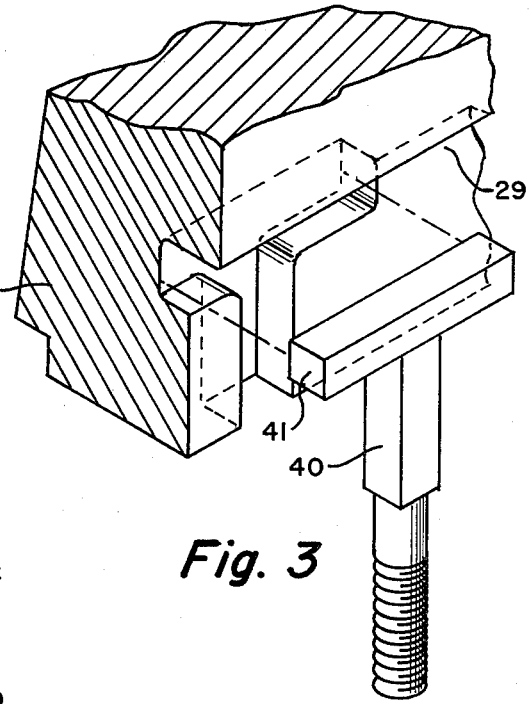
FIG. 3 is an enlarged perspective view of one embodiment of a fastener for attaching the vented plug assembly to a coke oven door.

Each of the U-shaped refractory plug segments 27A–27D is attached to the coke oven door through the use of one or more fasteners. In FIGS. 1–3, the fastener takes the form of a threaded bolt member 40 having a T-shaped head 41. A T-shaped slot is provided in the leg section 28 to receive the head of bolt 40. The round threaded portion of the bolt extends through a round opening in the door frame where at the outside surface thereof, a nut member 42 is used to clamp the T-bolt in place so that it is held rigidly in place against the door frame, but holds the refractory plug segments only loosely against the door frame. FIG. 1 shows the round shank of the T-bolt extending through several parts of the door which clamps together by virtue of tension in the round portion of the shank of the bolt, the bolt being stopped from going through these members by virtue of the square portion of its shank. It is important that the plug segments are retained loosely so that the leg sections are free to move toward and away from each other in response to a thermal gradient across the thickness of the refractory plug segment. Moreover, each refractory plug segment is free to expand and contract in the vertical direction of the door since a gap always exists between the plug segments in their superimposed relation.

Figure 4:
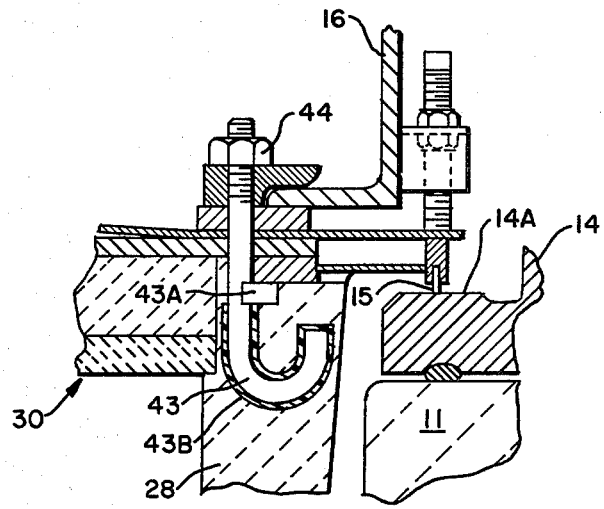
FIG. 4 is a partial sectional view similar to FIG. 1 but illustrating a second embodiment of a fastener device for attaching the vented plug assembly to a coke oven door.

FIG. 4 illustrates a second embodiment of a fastener used to retain the plug assembly on the coke oven door. This embodiment of the fastener means differs from that already described by the use of a hook-shaped end 43 that is embedded within the refractory material forming each leg section of the plug segments. The threaded end of the fastener extends through an annular opening and is retained on the coke oven door by a nut member 44 at the outside surface of the door. In this construction, the bolt is wrapped or coated with a thickness of organic material, as shown at 43B, which will burn away in service, thus giving a loose assembly of parts so that the relative expansions alluded to above can occur. Some form of stopping member, such as plate 43A, is welded or otherwise affixed to the shank of the hook bolt in order that other parts of the door which are normally clamped together by these bolts are not also loosened by the burning away of the organic material.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A vented coke oven door apparatus for a coke oven chamber to form a removable end closure to the coke oven refractory and relieve the pressure of coke oven gas generated at the bottom of a coal charge in the coke oven chamber, said vented coke oven door assembly including the combination of:

a door frame having a vertically-extended height substantially corresponding to the height of a coke oven chamber, a plug assembly defining a vertical internal passageway while supported by said door frame along one vertical face surface thereof to project into a coke oven chamber for conducting coke oven gas from the bottom portion of the coke oven chamber to the top portion thereof, said plug assembly including a plurality of U-shaped refractory plug segments arranged in an end-to-end aligned relation with leg sections of each U-shaped segment extending to the vertical face surface of the door frame, said plug assembly further including a back-plug means spanning the distance between the leg sections of the plug segments while extending along the door frame to thermally protect the door frame from contact with coke oven gas flowing along the vertical internal passageway of the plug assembly, a fastener extending between said door frame and each leg section of the U-shaped refractory plug segments, each of said refractory plug segments being supported by a fastener engaged with each leg section of the "U" shape to permit movement of the leg sections toward and away from each other due to thermal expansion in response to a thermal gradient across the wall of each refractory plug segment, seal means extending around the outer periphery of said door frame to prevent the emission of coke oven gas from the coke oven chamber, and latch means carried by said door frame for support thereof.

2. The vented coke oven door apparatus according to claim 1 wherein said back-plug means includes a layer of insulation facing said door frame and a layer of refractory material overlying said layer of insulation to define a side closure wall to the internal space of said refractory plug segments for conducting coke oven gas therealong.

3. The vented coke oven door apparatus according to claim 2 wherein the refractory plug segments and the layer of refractory material define a vertical flow space for coke oven gas having a horizontally, transverse cross-sectional area of at least 32 square inches to thereby continuously maintain an unplugged flow space for coke oven gas along conductively-heated walls of the refractory plug segments.

4. The vented coke oven door apparatus according to claim 3 wherein said refractory plug segments have a wall thickness between about 2 inches and 3 inches for effective heat transfer to burn away deposits from the wall surface thereof forming the vertical internal flow space.

5. The vented coke oven door apparatus according to claim 1 wherein said fastener for each of said refractory plug segments includes a threaded bolt member having a hook-shaped end embedded within a leg section thereof.

6. The vented coke oven door apparatus according to claim 1 wherein said fastener includes a threaded bolt member having a T-shaped head.

7. The vented coke oven door apparatus according to claim 6 wherein each leg section of said refractory plug segments includes a T-shaped slotted opening within the side wall thereof for supporting the T-shaped head of said threaded bolt member.

8. The vented coke oven door apparatus according to claim 2 wherein each leg section of said refractory plug segments includes a recess along the length of the leg section for receiving the longitudinal side edge of said back-plug means in an interfitting relation.

9. The vented coke oven door apparatus according to claim 1 wherein said back-plug means includes a rectangular backing plate extending along the flow space for coke oven gas, said backing plate being supported upon said door frame by engagement with said refractory plug segments.

* * * * *